United States Patent [19]

Perkins

[11] 4,456,257

[45] Jun. 26, 1984

[54] GOLF CLUB SWING TRAINING DEVICE

[76] Inventor: Sonnie J. Perkins, 1437 180th NE., Bellevue, Wash. 98008

[21] Appl. No.: 418,815

[22] Filed: Sep. 16, 1982

[51] Int. Cl.[3] ..... A63B 69/36

[52] U.S. Cl. ..... 273/186 R; 273/186 A; 273/186 C

[58] Field of Search ..... 273/183 D, 183 B, 186 A, 273/194 R, 186 R, 183 E, 193 R, 162 R, 186 C

[56] References Cited

U.S. PATENT DOCUMENTS

| | | | |
|---|---|---|---|
| 2,080,608 | 5/1937 | Hannaford | 273/183 D |
| 3,070,373 | 12/1962 | Mathews et al. | 273/194 R X |
| 3,191,939 | 6/1965 | Hooper | 273/186 A |
| 3,707,291 | 12/1972 | Tredway | 273/183 B |
| 3,753,564 | 8/1973 | Brandell | 273/186 A |
| 4,342,456 | 8/1982 | Miyamae | 273/186 A |

*Primary Examiner*—George J. Marlo
*Attorney, Agent, or Firm*—William W. Haefliger

[57] ABSTRACT

A golf club is provided with swing plane sensing apparatus. Light beams are projected in opposite and parallel directions lengthwise of the club shaft. The beams may be projected axially of the shaft, or outside the shaft.

13 Claims, 7 Drawing Figures

65
64
60a
61a
63
19a
19b
74
75
60
61
16
17
19c
65

25
11

27
14
72
1c
18
1c
27a
21
70
71
14
27
73
31
27b
30
25b
34
32
33

10
11
25
1a
1a
13
12
26
20
74
15
16, 17

25
12
26a
25a

GOLF CLUB SWING TRAINING DEVICE

BACKGROUND OF THE INVENTION

This invention relates generally to apparatus to improve a golf swing, and more particularly concerns the provision of golf swing plane indicator means.

There is need for apparatus that will enable a golfer to train himself to swing the club correctly, i.e. in a proper plane, so that the struck ball will travel in a desired direction. Insofar as I am aware, no apparatus is available having the unusually advantageous elements, functions and results as are now afforded by the herein described apparatus.

SUMMARY OF THE INVENTION

It is a major object of the invention to provide training apparatus that will enable a golfer to correctly swing a golf club. Basically, the apparatus comprises means associated with the club to project a first light beam in a first direction generally lengthwise of the shaft to intersect the ground as the club is held in ball addressing position and then swung rearwardly, and to project a second light beam in a second and generally opposite direction lengthwise of the shaft to intersect the ground as the club is swung backwardly and upwardly when the free end or grip end of the shaft is directed toward the ground.

As will be seen, the described means may include at least one and preferably at least two light sources carried by the club to produce the illuminated paths; the light sources may project in opposite directions, and they may have an associated power source or sources carried by the club, or located externally of the club. Further, one beam may project close to the club head sweet spot, as will appear.

It is a further object to provide a light source on the forearm of the player to show the proper on-plane relationship of the right forearm at ball address and impact.

It is another object of the invention to provide the light sources in the form of fiber optics light pipes, or in the form of incandescent bulbs, or in other forms.

ADVANTAGES INCLUDE (1) The golfer may visually discern the plane in which he is swinging the club;

(2) If the golfer is swinging properly, in a proper plane, maximum power is delivered to the ball;

(3) Sensors may be provided to register whether or not the swing is in the correct plane;

(4) The apparatus does not hinder the proper swing of the club.

(5) The apparatus indicates that the right forearm is also on plane at ball address and impact, for power support.

These and other objects and advantages of the invention, as well as the details of an illustrative embodiment, will be more fully understood from the following specification and drawings, in which:

DRAWING DESCRIPTION

FIG. 1 is a side elevation showing a golf club incorporating the invention;

FIGS. 1*a* and 1*c* are enlarged sections taken on lines 1*a*—1*a* and 1*c*—1*c* of FIG. 1;

FIG. 1*b* is an enlarged vertical section showing a light pipe terminal at the head;

FIG. 3 is a side elevation showing a golf club incorporating a modified form of the invention; and FIG. 4 is a side elevation showing a golf club incorporating a further modified form of the invention.

DETAILED DESCRIPTION

Figures 1, 1A, 1B, 1C, 2:
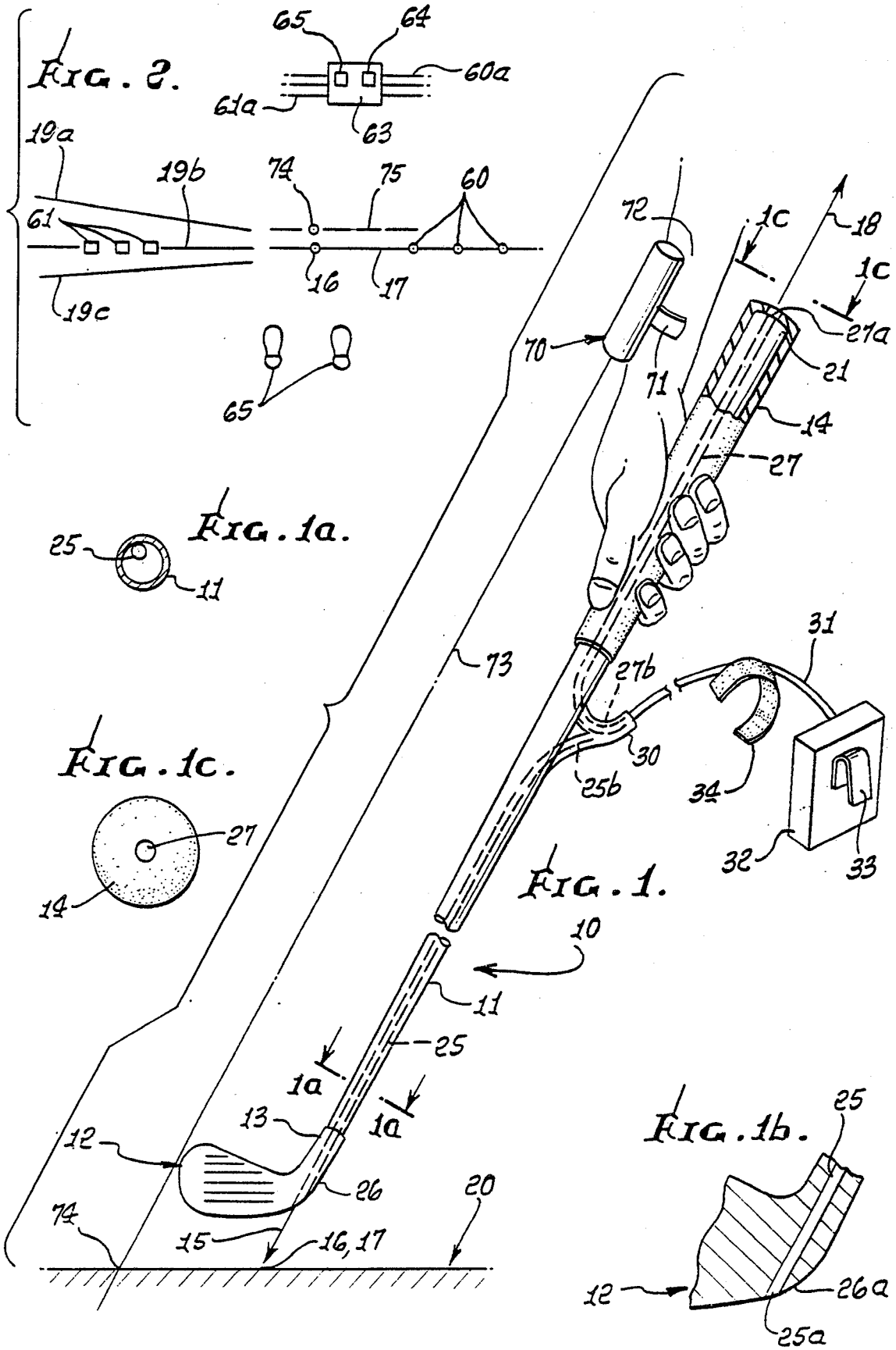
FIG. 2 is a plan view of two light paths on the ground.

In FIG. 1, a golf club 10 includes a straight hollow shaft 11, a ball striking head 12 and hosel 13 at the lower end of the shaft, and a grip 14 along the upper extent of the shaft. In accordance with the invention, means is associated with the club to project a first light beam (as at 15) in a first direction generally lengthwise of the shaft to intersect the ground 20 (as at point 16 in FIG. 2) as the club is held in ball addressing position, and also to intersect the ground along path 17 (in FIGS. 1 and 2) as the club is then swung rearwardly; also, the said means projects a second light beam (as at 18) in a second and diametrically opposite direction lengthwise of the shaft. Beam 18 intersects the ground along a second path (19*a*, or 19*b*, or 19*c*, for example) as the club is swung backwardly and upwardly to an extent that the free end 21 of the shaft is directed toward the ground. For a correct swing, the second path should be in the same plane as the front path 17, i.e. path 19*b* would be correct, but paths 19*a* and 19*c* (and associated swings) would be incorrect as they are outside the plane of, or not in alignment with, path 17. In this regard, the invention provides an observable indication at ground level of the plane in which the club is swung, during the swing, thereby showing the golfer whether or not the swing is properly oriented to maximize power delivery to the ball, swing efficiency, and swing direction. Note the player's feet location, at 65.

In the embodiment shown in FIGS. 1, 1*a*, 1*b* and 1*c*, a light source carried by the club includes a first fiber optics line 25 (first light source) that extends within the hollow shaft to the head 12, and terminates at 25*a* at the lower edge 26*a* of heel 26. It projects light 15 onto the ground as at 16 and 17, described above. The light source carried by the club also includes a second fiber optics line or conduit 27 (second light source) that extends within the hollow shaft to terminate at 27*a* at the upper end of the shaft or grip. It projects light beam 18 diametrically opposite to beam 15, to define path 19*a*, 19*b* or 19*c* (or other similar path) which may extend toward path 17, and possibly meet same, as the club is swung back to extreme extent.

The two lines 25 and 27 are carried within the hollow shaft, and project outwardly and sidewardly therefrom at 25*b* and 27*b*, as via a short side duct or ducts 30. The lines 25 and 27 then are enclosed in a flexible cable 31 leading to light generator, and power source in container 32. The latter carries a clip 33 to attach to the player's belt. Cable 31 may be attached via strap 34 to the player's wrist, using VELCRO, or other attachment means. Accordingly, the club may be swung with minimum of interference and/or distortion, as compared with a conventional club, and the user may perfect his swing by visual interpretation of the light paths as described.

In the modification shown in FIG. 3, the elements 10, 11, 12, 13 and 14 remain the same. The head front face has a "sweet spot" indicated at 35. A first light beam is projected at 36 in a downward direction generally parallel to the shaft to intersect the ground just forwardly of the sweet spot; thus, in FIG. 3, beam 36 passes in front of the sweet spot. Beam 36 is slightly offset from the shaft centerline 11*a*, and is projected from a light source 37 in a lightweight holder 38 attached at 39 to shaft 11. A wire 40 supplies power from external power (as for example battery) source 41, the wire wrapping about shaft 11. Light source 37 may include an incandescent bulb, and associated dished reflector to define narrow beam 36. A second and diametrically opposite light beam 42 is projected upwardly (in the same manner as beam 18 in FIG. 1), as from a light source 43 at the upper end of the shaft or grip. Source 42 may likewise comprise an incandescent bulb and reflector, housed in barrel 44; a second wire 45 supplies current from power source 41 to the bulb, and the wire is carried or extends within the shaft interior, interiorly of the grip.

In FIG. 4, the elements 10–14 are again the same. In this instance a battery or batteries are carried at 50 within the shaft extent enclosed by the grip, to supply power to light source or bulb 43*a* to produce beam 42*a* (like beam 42). Such battery (or additional battery) may supply current to the front light source or bulb 37*a* (like source 37) that produces beam 36*a* (like beam 36). An additional battery (or batteries) 51 as referred to may be carried in a holder tube 52 which is elongated, and carried at 53 by the shaft.

Referring back to FIG. 2, if desired, light sensors 60 may be located at ground level along path 17, and light sensors 61 located along (correct) path 19*b*. Such sensors may be electrically connected, as by leads 60*a* and 61*a* to a recorder or other device 63 to record whether or not the club has been swung so that the light beams sweep over one or both of the paths 17 and 19*b*. If path 17 was swept, light 64 comes "ON", and if path 19*b* was swept, light 65 comes "ON," for example. Device 63 contains appropriate circuitry to effect energization of lights 64 and 65. Other indicators 64 and 65 may be used, such as buzzers, etc.

In FIG. 1, an auxiliary means indicated at 70 attaches (as by VELCRO 71, or other clip) to the player's forearm 72 (right forearm for right-handed player). It may comprise a generator of light beam 73 that is projected generally parallel to, and offset from, shaft 11, and intersects the ground at 74. See also the line 75 it describes in FIG. 2 as the club is swung, parallel to line 17, so that the player may observe lines 75 and 17 to maintain proper grip during the back swing and during the down swing to impact the ball.

In FIG. 2, devices 60 and 61 may also represent generators of up-beams that define a desired swing plane. Devices 25,37 and 37*a* may then represent detectors that detect the up-beams as during a desired swing.

What is claimed is:

1. In a golf swing plane sensor, the combination comprising (a) golf club having a shaft and ball striking head, and (b) means associated with the club to project a first light beam in a first direction lengthwise of the shaft to intersect the ground as the club is held in ball addressing position and then swung rearwardly, and to project a second light beam in a second and diametrically opposite direction lengthwise of the shaft to intersect the ground as the club is swung backwardly and upwardly so the free end of the shaft is directed toward the ground.

2. The combination of claim 1 wherein said means comprises at least one light source carried by the club.

3. The combination of claim 2 including a second light source carried by the club, the one light source producing the first beam, and the second light beam producing the second beam.

4. The combination of claim 3 wherein the second beam is directed to pass adjacent to and frontally of a sweet spot defined by the head.

5. The combination of claim 3 wherein said sources are defined by light bulbs.

6. The combination of claim 5 including electric battery means carried by the club and operatively connected with said bulbs.

7. The combination of claim 1 wherein said means comprises a first light source directed in said first direction, and a second light source directed in said second direction, said light sources carried by the club.

8. The combination of claim 7 wherein said means includes a power source externally of the club and operatively connected with said light sources.

9. The combination of claim 7 wherein said light sources include fiber optics light pipes.

10. The combination of claim 9 wherein said light sources include light generation apparatus free of the club, said light pipes emerging from the club shaft to extend to said apparatus.

11. The combination of claim 10 wherein said apparatus includes a container having a clip attachable to the player's attire.

12. The combination of claim 9 wherein said light pipes respectively have terminals at the club head and at the end of the shaft remote from the head.

13. The combination of claim 1 including sensor means sensitive to said beams to sense whether or not one or both of the light beams have traversed predetermined path or paths adjacent the ground, during the golf swing.

* * * * *

Notice of Adverse Decisions in Interference

In Interference No. 101,424, involving Patent No. 4,456,257, S. J. Perkins, GOLF CLUB SWING TRAINING DEVICE, final judgment adverse to the patentee was rendered March 31, 1988, as to claims 1-13.

*(Official Gazette February 20, 1990)*